US012768081B2

(12) United States Patent
Röder et al.

(10) Patent No.: US 12,768,081 B2
(45) **Date of Patent: *Oct. 20, 2026**

(54) METHOD FOR PRODUCING REGENERATED CELLULOSIC FIBERS

(71) Applicant: TreeToTextile AB, Stockholm (SE)

(72) Inventors: Thomas Röder, Vöcklabruck (AT); Friedrich Suchomel, Schörfling (AT); Christian Mayrhofer-Huber, Timelkam (AT); Markus Duschlbauer, Timelkam (AT)

(73) Assignee: TreeToTextile AB, Stockholm (SE)

( * ) Notice: Subject to any disclaimer, the term of this patent is extended or adjusted under 35 U.S.C. 154(b) by 81 days.

This patent is subject to a terminal disclaimer.

(21) Appl. No.: 18/292,781

(22) PCT Filed: Jul. 22, 2022

(86) PCT No.: PCT/EP2022/070611

§ 371 (c)(1),
(2) Date: Jan. 26, 2024

(87) PCT Pub. No.: WO2023/006604

PCT Pub. Date: Feb. 2, 2023

(65) Prior Publication Data

US 2025/0084566 A1 Mar. 13, 2025

(30) Foreign Application Priority Data

Jul. 26, 2021 (EP) ..... 21187688

(51) Int. Cl.
*D01D 1/02* (2006.01)
*D01D 5/06* (2006.01)
(Continued)

(52) U.S. Cl.
CPC ..... *D01F 2/02* (2013.01); *D01D 5/06* (2013.01); *D01D 5/26* (2013.01); *D01D 10/06* (2013.01); *D01D 13/00* (2013.01)

(58) Field of Classification Search
CPC .. D01D 1/02; D01D 5/06; D01D 5/12; D01D 5/22; D01D 5/26; D01D 10/06; D01F 2/02; D01G 1/02; D01G 9/00; D04H 1/4258
(Continued)

(56) References Cited

U.S. PATENT DOCUMENTS 2,774,441 A 12/1956 Buurman
2,923,604 A 2/1960 Fawley et al.
(Continued)

FOREIGN PATENT DOCUMENTS

BR 9508084 A 11/1997
CA 2193370 A1 12/1995
(Continued)

OTHER PUBLICATIONS

Translation of CN 103147144 A (published on Jun. 12, 2013).*
(Continued)

*Primary Examiner* — Leo B Tentoni
(74) *Attorney, Agent, or Firm* — Husch Blackwell LLP

(57) ABSTRACT

A method and a production facility for producing regenerated cellulosic fibers. A spinning solution is extruded into a coagulation bath which contains a salt and preferably an alkali. The spinning solution comprises cellulose dissolved in an aqueous solvent comprising NaOH and ZnO and the coagulation bath has a pH-value of at least seven. The fibers in the fiber tow are fixated and stretched to essentially their final cellulose specific diameter before being cut to staple fibers in an undried state.

7 Claims, 2 Drawing Sheets

(51) Int. Cl.

| | |
|---|---|
| ***D01D 5/12*** | (2006.01) |
| ***D01D 5/22*** | (2006.01) |
| ***D01D 5/26*** | (2006.01) |
| ***D01D 10/06*** | (2006.01) |
| ***D01D 13/00*** | (2006.01) |
| ***D01F 2/02*** | (2006.01) |
| ***D01G 1/02*** | (2006.01) |
| ***D01G 9/00*** | (2006.01) |
| ***D04H 1/4258*** | (2012.01) |

(58) Field of Classification Search
USPC ..... 264/103, 140, 141, 142, 143, 145, 148, 264/168, 178 F, 187, 203, 210.2, 210.8, 264/211.12, 211.14, 211.15, 233; 28/282
See application file for complete search history.

(56) References Cited

U.S. PATENT DOCUMENTS

| | | | | |
|---|---|---|---|---|
| 3,084,021 | A * | 4/1963 | Morimoto | D01D 5/22 427/175 |
| 3,434,913 | A | 3/1969 | Bockno et al. | |
| 3,547,837 | A | 12/1970 | Ashikaga et al. | |
| 3,720,743 | A | 3/1973 | Dexter et al. | |
| 4,583,984 | A * | 4/1986 | Turunen | D01F 2/00 264/187 X |
| 5,094,690 | A | 3/1992 | Zikeli et al. | |
| 5,888,288 | A | 3/1999 | Quigley et al. | |
| 2016/0138200 | A1 | 5/2016 | Stigsson et al. | |
| 2018/0119312 | A1 | 5/2018 | Yoshimura et al. | |
| 2019/0062950 | A1 | 2/2019 | Hedlund et al. | |
| 2019/0185586 | A1 | 6/2019 | Olsson et al. | |
| 2019/0345641 | A1 | 11/2019 | Jung et al. | |
| 2020/0063352 | A1 | 2/2020 | Parker et al. | |
| 2020/0079925 | A1 | 3/2020 | Haslinger | |
| 2020/0299416 | A1 * | 9/2020 | Stigsson | D01F 2/02 |
| 2021/0062369 | A1 | 3/2021 | Klaus-Nietrost et al. | |
| 2024/0058511 | A1 | 2/2024 | Kim | |

FOREIGN PATENT DOCUMENTS

| | | | | |
|---|---|---|---|---|
| CA | 3145647 | A1 * | 2/2021 | D04H 1/4258 |
| CN | 1172487 | A | 2/1998 | |
| CN | 103147144 | A * | 6/2013 | D01F 2/02 |
| CN | 104220669 | A | 12/2014 | |
| CN | 109415844 | A | 3/2019 | |
| CN | 110172754 | A | 8/2019 | |
| CN | 210177024 | U | 3/2020 | |
| EP | 0538977 | A1 | 4/1993 | |
| EP | 1900860 | A1 | 3/2008 | |
| EP | 2692924 | A1 | 2/2014 | |
| EP | 3231899 | | 10/2017 | |
| EP | 3231901 | | 10/2017 | |
| EP | 3443151 | A1 | 2/2019 | |
| GB | 1318122 | A | 5/1973 | |
| PL | 388030 | A1 | 11/2010 | |
| PL | 214565 | | 8/2013 | |
| WO | 1995028516 | A1 | 10/1995 | |
| WO | 2013122731 | A1 | 8/2013 | |
| WO | 2018169479 | | 9/2018 | |
| WO | 2020041256 | A1 | 2/2020 | |
| WO | 2020126931 | A1 | 6/2020 | |
| WO | 2020171767 | | 8/2020 | |
| WO | 2020171767 | A1 | 8/2020 | |

OTHER PUBLICATIONS

International Search Report and Written Opinion mailed Oct. 19, 2022 for Intl. Appl. No. PCT/EP2022/070611.
Machine Translation of PL214565, (published on Aug. 30, 2013).
Chinese Office Action for Application No. 2022.80059614.X dated Feb. 2, 2026, 17 pages including translation.
Chinese Office Action for Application No. 202280065051.5, dated Dec. 18, 2025, 9 pages including translation.
International Search Report and Written Opinion dated Dec. 11, 2022 for Intl. Pat. App. No. PCT/EP2022/0704194.
International Search Report and Written Opinion dated Oct. 20, 2022 for International Pat. Appl. No. PCT/EP2022/070612.
International Search Report and Written Opinion mailed Nov. 9, 2022 for Intl. Appl. No. PCT/EP2022/070612.
International Search Report and Written Opinion mailed Nov. 28, 2022 for Intl. Appl. No. PCT/EP2022/070609.
Machine Translation of CN110172754. (published on Aug. 27, 2019).
European Communication pursuant to Article 94(3) EPC for Application No. 22754086.1, dated Jun. 29, 2026, 6 pages.

* cited by examiner

METHOD FOR PRODUCING REGENERATED CELLULOSIC FIBERS

CROSS REFERENCES

The application is a U.S. National Phase Application of International Application No. PCT/EP2022/070611 filed on Jul. 22, 2022, which claims priority to European Application No. 21187683.3, filed on Jul. 26, 2021, the disclosures of each of which are hereby incorporated herein by reference in their entireties.

TECHNICAL FIELD

The current disclosure relates to innovations in the field of the production, use and application of man-made cellulosic fibers. Particularly the current disclosure relates to processes for the production of regenerated cellulosic fibers which are produced according to a cold-alkali process, the thus produced fibers and their use.

BACKGROUND

Man-made cellulosic fibers are manufactured fibers that are based on cellulosic matter as a source material.

In the context of the current disclosure the term "cellulose" denotes an organic compound derived from plant cell walls or synthetically produced. Cellulose is a polysaccharide and is unbranched. Typically, cellulose comprises several hundred to ten thousand β-D-glucose molecules (β-1, 4-glycosidic bound) or cellobiose units, respectively. The cellulose molecules that are used by plants to produce cellulose fibers are also used in technical processes to produce regenerated cellulose.

The term "regenerated cellulose" denotes a class of materials manufactured by the conversion of natural or recycled cellulose to a soluble cellulosic derivative or a directly dissolved cellulose solution and subsequent regeneration, forming shaped bodies, such as fibers (e.g., rayon), films or foils (e.g., cellophane) or bulk solids (e.g., beads, powders or pellets).

The term "fibers", as it is used herein, denotes continuous filaments as well as cut staple fibers of any desired length.

Cellulosic fibers can also be in the form of a woven, knitted or non-woven fabric comprising the cellulosic fibers. Woven fabrics comprise textile planar fabrics made from at least two crossed thread systems, which can be referred to as warp- and weft-yarns. By contrast, the yarn in knitted fabrics follows a meandering path (a course), forming symmetric loops (also called bights) symmetrically above and below the mean path of the yarn.

The term "non-woven fabric" denotes fabrics that are neither woven nor knitted. Non-woven fabrics can be in the form of a fabric comprising randomly oriented fibers and/or cut yarns of finite length. Non-woven fabrics can also comprise endless yarns, e.g., produced by a melt-blown-process.

As viscose fibers, regenerated cellulosic fibers are denoted, which are manufactured by means of a wet spinning method which is called viscose-method. The starting raw material of the viscose-method is cellulose which is usually provided on the basis of wood. From this starting raw material, a highly pure cellulose in form of chemical pulp is obtained. Additionally, or as an alternative, other cellulosic materials, such as bamboo, cotton linters, recycled cellulosic materials, reed, etc., or mixtures of such materials can be used as a starting raw material. In subsequent process stages, the pulp is first treated with caustic soda (NaOH), whereby alkali cellulose is formed. In a subsequent conversion of said alkali cellulose with carbon disulfide, cellulose-xanthogenate is formed. From this, by further supplying NaOH, the viscose-spinning solution is generated which is pumped through holes of shower-like spinning nozzles into a coagulation bath (also referred to as spin bath). There, one viscose-filament per spinning nozzle hole is generated by coagulation. To coagulate the spinning solution, an acidic coagulation bath is used. The thus generated viscose-filaments are subsequently post processed. The post processing usually comprises several washing and stretching steps and the filaments are cut to viscose-staple fibers. Several other post-processing steps, such as crimping, bleaching and/or finishing ("soft finish") can be performed on the uncut and/or the cut fibers. In the context of this document, the term "viscose process" denotes such a xanthogenate process.

The term "Lyocell", as used herein, denotes a regenerated fiber type comprising cellulose, which is manufactured according to a direct solvent method. The cellulose for the lyocell-method is extracted from the raw material containing the cellulose. The thus obtained pulp may subsequently be dissolved in a suitable solvent under dehydration without chemical modification. In large-scale industrial implementation N-methylmorpholine-N-oxide (NMMO) is currently used a solvent, nonetheless it is known that other solvents, such as ionic liquids, can also be used for the process. The solution is then filtered and, for the production of fibers, subsequently extruded through spinning nozzles into an air gap where they are drawn and coagulated by means of a moist airstream and then are fed into a coagulation bath containing an aqueous NMMO-solution. Subsequently the fibers can be further processed, e.g., washed, bleached, finished, crimped, cut to staple fibers, etc.

Another well-known process for the manufacturing of regenerated cellulose fibers is the carbamate-method, which is similar to the viscose-process but uses urea instead of carbon disulfide. Still another process, which is called modal-process, is a modified viscose-process for the production of higher quality fibers. For these processes, also an acidic coagulation bath is used.

Further, processes for manufacturing of cellulosic products are known that can use an alkaline spin bath comprising a salt. To prepare the spinning solution, cellulose is dissolved in an aqueous alkaline medium at a controlled temperature. Such processes are herein generally denoted as "cold-alkali process".

WO2018/169479 discloses an example of a fiber produced by a cold-alkali process. The method comprises: providing a spinning dope comprising a solution of cellulose and an additive in an alkaline solvent, in which solvent cellulose is present at a concentration of from about 5 to 12 percent per weight by weight and the additive is present in the range of from 0.1-10 percent per weight by weight calculated on the cellulose; contacting the cellulose spinning dope with an aqueous coagulation bath fluid having a pH value above 7 and comprising a salt; forming a regenerated cellulosic fiber composition; and stretching and washing the fiber composition in one or more washing and stretching baths.

EP3231901A1 discloses a similar process, wherein a spin dope is prepared by dissolving cellulose in an aqueous NaOH solution. The spin bath comprises a coagulation liquid comprising an aqueous sodium salt solution.

EP3231899A1 discloses a method for preparing a spin dope by direct dissolution of cellulose in cold alkali.

WO2020171767A1 discloses a process for forming a fiber tow involving a wet spinning procedure comprising the steps of: dissolving cellulose pulp in an alkaline aqueous solvent to form a cellulose spin dope composition, spinning the cellulose spin dope composition in a coagulation bath having a pH of more than 7.0, preferably a pH of at least 10, to produce a fiber tow, and passing the produced fiber tow through a sequence of consecutive stretching and washing steps in which the formed fiber tow is washed with a washing liquid by a counter-current flow washing procedure.

Especially fibers that are produced according to the cold-alkali process issue numerous challenges to the post-processing of the fiber. Subsequent production steps, such as carding, yarn spinning, textile production or fleece production, require staple fibers having, for example, a sufficiently high tenacity, low brittleness and an appropriate crimp.

Still there exists a need for new and innovative production methods and facilities that allow for a scale-up of the production of cold-alkali fibers to large-industry dimensions.

SUMMARY

The present disclosure describes methods and apparatuses for producing regenerated fibers that are produced according to a cold-alkali process.

In a first aspect the present disclosure relates to a method for producing regenerated cellulosic fibers comprising extruding a spinning solution into a coagulation bath which contains a salt and preferably an alkali to produce a fiber tow, the spinning solution comprising cellulose dissolved in an aqueous solvent comprising NaOH and ZnO, the coagulation bath having a pH-value of at least seven, wherein the fibers in the fiber tow are stretched to essentially their final cellulose specific diameter and oriented to essentially their final state before being cut to staple fibers in an undried state.

It was surprisingly found that stretching the fibers to their final cellulose specific diameter and state within the conditioning bath and cutting the fibers in an undried state allows for an economic and controllable production of fibers having adequate properties that allow, for example, a spinning of fibers to yarn.

The person skilled in the art and having knowledge of the teachings disclosed herein is able to choose a suitable salt for use in the coagulation bath. The salt facilitates a coagulation of the spinning solution and preferably can be present in the coagulation bath in a ratio ranging from 10 percent per weight to 30 percent per weight. Preferably, the salt is a sodium salt, e.g., sodium carbonate or sodium sulfate. Further suitable salts can be chosen by taking into account the Hofmeister series (also known as the lyotropic series), which classifies ions in order of their precipitation capacities. The salt should, for one thing, allow for a quick coagulation and secondly, it should facilitate recovery and recycling of the compounds. Alternative, but less preferred coagulation sodium salts include sodium salts wherein the counter ion is a carboxylate (e.g., formate, acetate, propionate, butyrate or benzoate), an aliphatic or aromatic sulfonate (e.g., benzenesulfonate, toluenesulfonate, or methanesulfonate), an aliphatic or aromatic phosphonate ion or mixtures thereof. Preferably, the anionic counter ion has a dense electric charge, placing it in the beginning of the Hofmeister series. Anionic counter ions having a dense electric charge are characterized as strongly "salting out" proteins, due to their ability to increase surface tension and organize water molecules in solvation shells around them. Further, the coagulation sodium salt is preferably a sodium salt precipitating as a hydrate. Preferably the molar ratio of water to sodium salt in the precipitated hydrate is at least 4:1.

The term "stretched to essentially the cellulose specific final diameter", as it is used herein, is to be interpreted to that effect that downstream of this stretching step no further stretching steps are preformed on the fiber tow, i.e. the diameter of the fibers is held essentially constant until the fibers are either cut (after which a small amount of relaxation is unavoidable and sometimes even intended) or dried (where the diameter of the fibers as it would be actually measured is reduced due to the loss of liquid, generally without any change of the stretch of the fibers).

The term "cellulose specific diameter", as it is used herein, denotes a diameter in a virtually washed and dried state, i.e., only comprising the dry cellulose. One example of a cellulose specific diameter which is used in connection with fibers is the fiber titer, which is defined as the weight of the cellulosic contents of the fiber per unit of length.

In case of fibers having a circular cross-section, the diameter corresponds to the diameter of the circular cross-section. As a generic definition, the diameter, as it is used herein, corresponds to the diameter of the largest circle that can be inscribed into the cross-section of the fiber (across the main axes). For example, the diameter of a fiber having an elliptic diameter would correspond to the lengths of the minor axis of the ellipse.

The term "oriented to essentially their final state", as it is used herein, is to be interpreted to that effect that the molecular orientation of the cellulose in the fibers is not actively changed in downstream processing steps, i.e. remains constant, apart from minor changes that may occur naturally or are a (generally unwanted) side effect of other downstream post-processing steps.

The term "undried", as it is used herein, defines a state, where the wet fiber has only been dewatered with mechanical means, i.e. by squeezing, and has not undergone any drying step. More specifically, the term designates a never-dried fiber, i.e. a fiber that has not undergone any drying step after extrusion.

According to one embodiment, after leaving the coagulation bath, the fiber tow is routed into at least one conditioning bath, the conditioning bath comprising from 10 percent per weight to 30 percent per weight a salt that facilitates a further coagulation of the spinning solution, the conditioning bath preferably being fluidly separated from a downstream washing line, wherein the fibers in the fiber tow are stretched to essentially their final cellulose specific diameter and oriented to essentially their final state in the at least one conditioning bath. The method allows for a cost-effective fiber production and reduces the complexity of threading the fiber tow at the production startup. It was surprisingly found that stretching the fibers to their final cellulose specific diameter and state within the conditioning bath allows for an economic and controllable production of fibers having adequate properties that allow, for example, a spinning of fibers to yarn. The process is scalable to large-industry scale.

The salt in the conditioning bath can preferably be identical to the salt that is used in the coagulation bath, or it can be chosen according to the same requirements as the salt in the coagulation bath that are outlined above.

According to a further embodiment, the coagulation bath and the conditioning bath can be fluidly connected, wherein the temperature of the coagulation bath and the temperature of the conditioning bath can preferably be independently set, adjusted and/or maintained. This facilitates the setup of optimized process conditions that allow for a complete and advantageous orientation and a strong stretching of the fibers in the conditioning bath.

The term "fluidly connected", as it is used herein, denotes units (e.g. a bath, such as the coagulation bath or the conditioning bath, or a washing unit) that are associated to the same circulation system, without having interposed between them an installation that significantly changes the properties of the liquid, e.g. by adding substances to and/or removing substances from the liquid or by concentrating or diluting the liquid. For example, one unit can be serially connected to another unit and being traversed by a liquid stream, e.g. in a countercurrent-arrangement or in a concurrent-arrangement. In another approach the fluidly connected units could be independently fed from the same reservoir.

The term "fluidly separated", as it is used herein, denotes systems that are either associated to completely separated circulation systems, or that are connected via an installation that significantly changes the properties of the liquid, e.g. by adding substances to and/or removing substances from the liquid or by concentrating or diluting the liquid.

Instead of only one conditioning bath, also a series of two or more conditioning baths could be applied. This would allow an individual adjustment of the temperature of the coagulation liquid and a stepwise stretching of the fibers at different temperatures. On one hand, this would increase the costs and the complexity of the production process, on the other hand it could be possible to improve fiber properties.

According to another embodiment, the fiber tow is routed through a washing line, the washing line comprising at least one washing step, wherein the washing line is preferable arranged downstream of the at least one conditioning bath, and wherein the tension of the fiber tow and the cellulose specific diameter of the fibers are preferably kept essentially constant in the washing line. This further "fixates" the orientation and the elongation of the molded bodies and allows for a good performance of the molded bodies, e.g. in terms of strengths and extensibility.

According to a further embodiment, the method further comprises the steps of: suspending the cut fibers and collecting them in form of a non-woven fiber layer, pressing the non-woven fiber layer, thereby imposing a natural crimp on the fibers. The method allows for the production of naturally crimped fibers having improved post-processing properties. For many applications a more natural crimp would be preferred. As it is used herein, the term "natural crimp" designates a crimp pattern of fibers that comprises waves of different and randomly distributed curvature and length. Such fibers resemble more closely to crimp of some natural fibers, such as cotton of wool.

The method described herein can further be improved by any technically feasible combination of one or more of the following steps:

- Washing the non-woven fiber layer preferably with water. Washing the already cut fibers in form of a non-woven fiber layer can be realized in a more economic way that it is possible with the uncut fiber tow.
- Neutralizing the cut or uncut fibers with an acidic liquid, wherein the acidic liquid is preferably selected from diluted acetic acid, lactic acid, sulphuric acid or the like. Alkaline residues can so be neutralized. Preferably a second washing step can be done after the neutralizing step to wash out the salts that formed during the neutralizing step.
- Bleaching the cut or uncut fibers.
- Application of a crosslinking agent on the cut or uncut fibers, e.g., to reduce fibrillation.
- Application of a finishing agent, particularly a soft finish, onto the cut or uncut fibers. The (soft) finishing, for example, improves the spinnability of the fibers and the quality of the so produced products.
- Drying the fibers, preferably in a drum dryer or a conveyor dryer. Already cut fibers are not subjected to a tensile stress during drying (as it would be in the case of drying the fiber tow before cutting) which can improve the fiber quality.
- Squeezing the fiber tow and/or the non-woven fiber layer before and/or after any other processing step. Squeezing can, for example, be easily done by running the non-woven fiber layer of cut fibers through pressing rollers. Especially at the beginning of the post-processing of the non-woven fiber layer the additional pressing can change and further improve the extent and quality of the crimp.

The steps listed above can be implemented in any technically reasonable and useful order, and the person skilled in the art, being aware of the current teachings, is able to implement numerous configurations without deviating from the current disclosure.

In another preferred embodiment the post-processing further can comprise at least one step of opening the non-woven fiber layer to loosen up and/or at least partially separate the fibers. The opening can improve downstream post-processing steps, such as drying and baling, and facilitates the opening of the baled fibers. On the other hand, the opening allows to provide a fiber layer with a higher density in the upstream post-processing steps, which can be then be implemented in a more economic way.

In a second aspect, the present disclosure relates to a processing facility for producing regenerated cellulosic fibers comprising a spinneret for extruding a spinning solution into a coagulation bath which contains a salt and preferably an alkali to produce a fiber tow, the spinning solution comprising cellulose dissolved in an aqueous solvent comprising NaOH and ZnO, the coagulation bath having a pH-value of at least seven, wherein the facility further comprises at least one stretching device for stretching the fibers in the fiber tow to essentially their final cellulose specific diameter and orienting the cellulose in the fibers to essentially their final state and a cutter for cutting to staple fibers in an undried state. The processing facility allows for the industrial implementation and scale-up of the methods disclosed herein.

In a preferred embodiment the facility further can comprise at least one conditioning bath downstream of the coagulation bath, the conditioning bath comprising from 10 percent per weight to 30 percent per weight a salt that facilitates a further coagulation of the spinning solution, the conditioning bath preferably being fluidly separated from a downstream washing line, and at least one stretching device for stretching the fibers in the fiber tow to essentially their final cellulose specific diameter and orienting the cellulose in the fibers to essentially their final state within the at least one conditioning bath.

According to another embodiment the coagulation bath and the conditioning bath are fluidly connected, wherein the temperature of the coagulation bath and the temperature of the conditioning bath can preferably be independently set, adjusted and/or maintained. By setting these parameters the coagulation speed can be optimized to provide sufficiently strong and extensible fibers.

According to a further embodiment the fiber tow is routed through a washing line, the washing line comprising at least one washing step, wherein the washing line is preferable arranged downstream of the at least one conditioning bath, and wherein the tension of the fiber tow and the cellulose specific diameter of the fibers are preferably kept essentially constant in the washing line. Washing the fiber tow in a tensioned state (and preferably without stretching them any further) can improve fiber properties.

In another embodiment the processing facility further can comprise a fleece-forming device for suspending the cut fibers and collecting them in form of a non-woven fiber layer, and at least on pressing device for pressing the non-woven fiber layer, thereby imposing a natural crimp on the fibers. A crimping facility in the fiber-tow line is not needed.

According to other embodiments, the processing facility may further comprise one or more treatment facilities, which are independently selected from a list comprising:

- one or more washing devices for washing the fiber tow or the non-woven fiber layer,
- one or more further pressing devices for squeezing the fiber tow or the non-woven fiber layer,
- a neutralizer for neutralizing the cut or uncut fibers with an acidic liquid,
- a bleaching facility for bleaching the cut or uncut fibers,
- a crosslinking facility for the application of a crosslinking agent on the cut or uncut fibers,
- a finishing facility for applying a finishing agent, particularly a soft finish, to the cut or uncut fibers,
- an opener for opening the non-woven fiber layer to loosen up and/or at least partially separate the cut fibers,
- a dryer, preferably a drum dryer or a conveyor dryer, to dry the fibers.

This improves the scalability and allows for large-scale industrial application. The facilities listed above can be implemented in any technically reasonable and useful order and the person skilled in the art, being aware of the current teachings, is able to implement numerous configurations without deviating from the current disclosure.

In a third aspect, the present disclosure relates to regenerated cellulosic fibers produced in a processing facility as described herein and/or produced by a method as described herein. The fibers can meet enhanced quality standards, both in view of requirements for further processing steps as well as in terms of properties of intermediate- and end products comprising the fiber.

In another aspect the present disclosure relates to a product, particularly a consumer product or an intermediate product, comprising the regenerated cellulosic fibers as disclosed herein. Preferably, the product can be selected from a list comprising yarns, fabrics, textiles, home textiles, garments, nonwovens, hygiene products, upholstery, technical applications, such as filter material, paper.

These and other aspects are merely illustrative of the innumerable aspects associated with the present disclosure and should not be deemed as limiting in any manner. These and other aspects, features, and advantages of the present disclosure will become apparent from the following detailed description when taken in conjunction with the referenced drawings.

BRIEF DESCRIPTION OF THE DRAWINGS

Reference is now made more particularly to the drawings, which illustrate the best presently known mode of carrying out the present disclosure and wherein similar reference characters indicate the same parts throughout the views.

DETAILED DESCRIPTION OF THE DRAWINGS

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

In the following detailed description numerous specific details are set forth in order to provide a thorough understanding of the present disclosure. However, it will be understood by those skilled in the art that the present disclosure may be practiced without these specific details. For example, the present disclosure is not limited in scope to the particular type of industry application depicted in the figures. In other instances, well-known methods, procedures, and components have not been described in detail so as not to obscure the present disclosure.

The headings and sub-headings used herein are intended only for general organization of topics within the present disclosure and are not intended to limit the disclosure of the technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Detailed Description" section of this specification are hereby incorporated by reference in their entirety.

Figure 1:
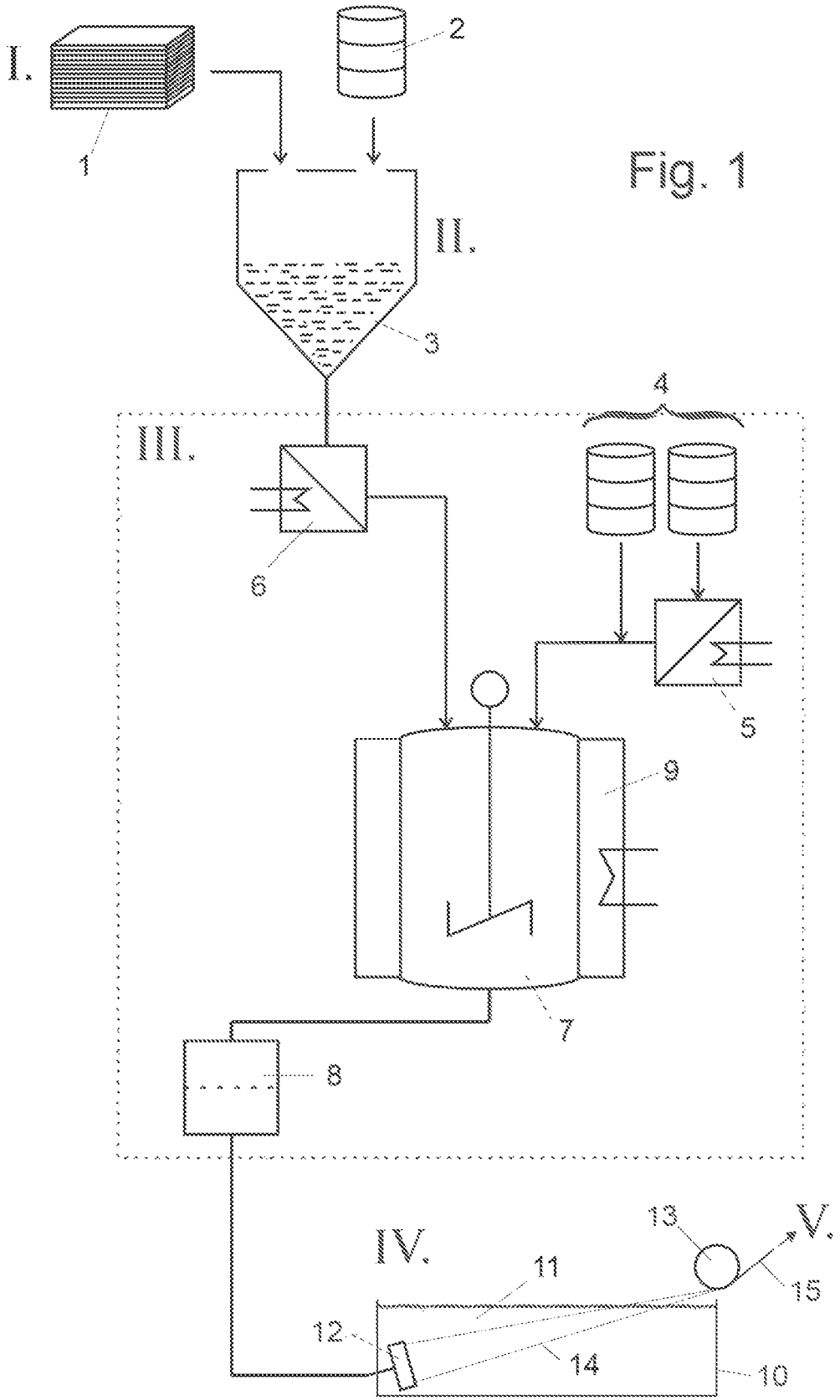
FIG. 1 is a schematic and exemplified representation of a fiber production process according to the present disclosure focusing on the spinning dope preparation and FIG. 2 is a schematic and exemplified representation of processing facility according to the present disclosure focusing on the post-processing of the spun fibers.

FIG. 1 shows a flowchart representing an exemplary fiber production process according to the present disclosure. The diagram is a simplified representation and shows the process in a schematized manner.

The process can be sectioned into the following basic steps, which are denoted in with roman numbers in FIG. 1:

I. Supplying the Raw Material

For the process according to the present disclosure a broad range of possible cellulosic raw materials can be used. Generally the intrinsic viscosity and the degree of polymerization of the cellulose used as a raw material is lower than it is common for the viscose- or lyocell-process. For example dissolving pulp (kraft or sulphite) with an intrinsic viscosity (measured in Cuen, according to SCAN-CM 15:99) of about 200 mL/g to 700 mL/g (degree of polymerization DP of 500 to 1900), preferably between about 250 and about 400 mL/g (DP or 600 to 950) can be used. Further, recycling pulp or cotton linters (preferably having the same DP as stated above) can be used. The recycling pulp can, for example, be derived from waste paper, recycled viscose textile material, recycled modal textile material, recycled lyocell textile material an/or recycled cotton fiber textile material. Blends of pulps of different origin, such as blends of virgin wood pulp with recycling pulp, are possible and may be even desirable.

In FIG. 1 a staple of dissolving pulp 1 is exemplarily depicted as the raw material II. Pretreatment of the Raw Material The cellulosic raw material can be subjected to a pretreatment, wherein the degree of polymerization is adjusted to a desired DP to adjust the viscosity of the spinning dope to a value that allows for filtering and spinning. The pretreatment can comprise subjecting the raw material to an acidic pulp treatment, wherein the DP-value is mainly influenced by the duration of the pretreatment and the concentration of the acid. In other cases, the pretreatment can be omitted, if the DP-value is already at the desired value. For example, pulp derived from cellulosic regenerate fibers may have a DP that allows for a direct dissolution without a pretreatment.

In a more specific example, an acidic pulp treatment with 1-10 percent per weight sulfuric acid at 50° C. to 95° C. for a duration from 5 min to 2 h can be used as a pretreatment. As the profitability of the process is reduced by a long duration of this treatment step, it is generally preferable to minimize the duration of the pretreatment as far as possible. The person skilled in the art, who is aware of the teachings of this disclosure is able to find suitable parameters and optimize them without undue burden.

The pretreatment further comprises washing the cellulosic material with water and pressing to reduce moisture content, e.g., to about 50 percent per weight of the cellulosic material.

In FIG. 1 a source for a pretreatment chemical 2, e.g., sulfuric acid, and a pretreatment vessel 3 are exemplarily depicted. After the pretreatment in pretreatment vessel 3 the cellulosic material can be squeezed and washed to reduce the amount of acid that is transported to the next step.

III. Preparation of the Spinning Dope

To prepare the spinning dope (also called spinning solution), the wet and pretreated pulp is first cooled to about 0° C. (while freezing of the pulp should be avoided), and an aqueous solvent comprising NaOH and ZnO is prepared. Preferably the solvent is adjusted to provide a spinning solution comprising 5 to 10 percent per weight NaOH and 0.8 to 3 percent per weight ZnO. The solvent is cooled down to a process temperature, which preferably lies between −5° C. and −10° C.

The pulp and the solvent are blended to dissolve the cellulose in the solvent. To improve the processability, the preparation of the spinning dope comprises a mixing step followed by a homogenization step. During the mixing step the blend is mixed with a high shear stress, which can be done in a high-shear mixer. This high shear stress mixing is preferably only performed for a rather short period of time, for example the mixing can be done for 1-2 minutes. In the following homogenization step the blend is agitated with a lower shear intensity. The homogenization step can last longer than the mixing step, for example about 5 minutes.

During both the mixing and the homogenization step the temperature of the mixture is controlled, especially cooled. Preferably the temperature is kept below 0° C. The process temperature should never exceed 5° C., as the solution could then thicken and be irrecoverably lost.

The so prepared spinning solution is then filtered and de-aerated. For example, the spinning dope can be filtrated at least twice via a KK filter (Kolben-Korb-Filter, Lenzing Technik) with a mesh size of 15 micrometer.

For the de-aeration the spinning solution is exposed to reduced pressure. This step is per-se known from the viscose process. Other techniques for filtering and de-aerating the dope that can be used are known to the person skilled in the art.

The prepared spinning dope should be free of voids, have a homogenous consistency and a proper viscosity that allows for an extrusion in the spinneret used in the following extrusion step.

In a preferred embodiment the ballfall-viscosity of the spinning dope should be in the range of about 30 to 200 s. The ballfall-viscosity can be measured according to DIN 53015-2019. The viscosity of the spinning dope can be adjusted by several different means. For example, the viscosity can be adjusted by altering the DP-value of the cellulose, by changing the composition of the solvent and/or the concentration of the cellulose in the spin dope. For example, the concentration of the cellulose can be in the range of about 4 percent per weight to about 12 percent per weight, particularly in the range of about 5 percent per weight to about 8 percent per weight preferably about 6 percent to about 7 percent per weight.

The specific parameters of the mixing, homogenization and filtering steps can be found by the person skilled in the art, who is aware of the current disclosure, by routine work and experimentation.

In FIG. 1 a chemical repository 4 for the storage of the ingredients of the solvent, a solvent cooling device 5 for the cooling of at least parts of the solvent, a pulp cooling device 6, a mixing vessel 7 and a de-aerating filter 8 are exemplarily depicted. The mixing vessel 7 is provided with a cooling jacket 9.

IV Extrusion into the Coagulation Bath

The spinning dope can be extruded through a nozzle directly into a coagulation bath. In case additives are added to the spinning dope, the dope can be homogenized via a static mixer to incorporate additives. Before the extrusion step, the dope can preferably be tempered to spinning temperature, for example to a temperature in the range of from 5° C. to 30° C. For fiber production, a straightforward approach could be to use as the extrusion nozzle a spinneret comprising, for example, up to 150 cups with a diameter of 12.5 to 16 mm, comprising up to 3000 holes with a diameter of about 40 to 75 micrometer, which corresponds to dimensions as they are known per se and commonly used in connection with the viscose spinning process. Nonetheless, it was surprisingly found that in connection with the cold-alkali process broader diameters can improve process stability and facilitate the coagulation and stretching of the fibers. According to the present disclosure it is therefore suggested to use a spinneret comprising holes with a diameter of about 80-120 μm, preferably between 90 and 110 μm. For example, in an industrial scale production plant one spinneret could comprise up to 150 cups with a diameter of 12.5 to 16 mm, comprising about 600 to 1400 holes with a diameter of about 80-120 μm, preferably between 90 and 110 μm. The relatively thick diameter of the spinning holes causes different course of coagulation, i.e. that the freshly extruded fibers first only coagulate at the outer surface, while the middle of the fiber stays in a liquid state for a longer time. This allows for a higher stretching and the stretching conditions can be uphold in a more stable way. The coagulation bath comprises an alkali, preferably NaOH, and a salt, preferably sodium carbonate, $Na_2CO_3$, or sodium sulfate, $Na_2SO_4$. As an example, the coagulation bath can comprise from 10 percent per weight to 30 percent per weight $Na_2CO_3$ or $Na_2SO_4$ and from 0 to 7.5 percent per weight NaOH, preferably from 0.1 to 3% and still more preferred from 0.2 to 0.7 percent per weight NaOH. In a specific example the coagulation bath can comprise about 22 percent per weight $Na_2CO_3$ and about 0.5 percent per weight NaOH. The temperature of the coagulation bath can, for example, be adjusted to between 10° C. and 30° C., and preferably be tempered at about 20° C.

The optimal distance, that the freshly extruded fiber travels through the coagulation bath (i.e. the coagulation bath distance) depends, inter alia, on the extrusion speed, the pull-off speed, the composition and consistency of the spinning dope, the composition of the coagulation bath and the temperature. Without being restricted to these values, under most parameter conditions the optimal coagulation bath distance may be found within a range from about 10 cm to about 100 cm. Preferred values for the coagulation bath distance range from about 15 cm to about 60 cm.

The fiber tow is drawn out of the coagulation bath to a transporting section, which can comprise several godets and/or pulleys that transport the fiber tow through a series of post-processing stages. The pull-off force that is exerted on the freshly extruded fibers can be regulated by the extrusion speed and the speed of the first transporting unit (or godet), which preferably can be positioned outside of the coagulation bath. Due to the pull-off force, which is exerted on the freshly extruded fibers by the first transporting unit, the fibers get stretched already inside the coagulation bath. Further stretching steps can be during the following post processing of the fibers.

In FIG. 1 a coagulation bath 10 comprising a coagulation liquid 11, a spinneret 12 and a first godet 13 are exemplarily depicted. The spinneret 12 extrudes a number of fibers 14 (corresponding to the number of holes of the spinneret 12) into the coagulation liquid 11. The freshly extruded fibers 14 are gathered together into a fiber tow 15 by the first godet 13. By adjusting the extrusion speed at the spinneret 12 and the speed of the godet 13 the amount of stretching, that is done directly after extrusion within the coagulation bath 10 can be set. Although an inclined angle of the spinneret 12 (and the freshly extruded fibers 14) is shown in FIG. 1, the skilled practitioner, who is aware of the current teaching, is able to apply other spinning configurations that are per se known in the field, e.g., from viscose production.

V. Post-Processing of the Fiber Tow

As it is used throughout this disclosure, the term "post-processing" encompasses all processing steps that are performed on the extruded fibers after they have been withdrawn from the coagulation bath. Post-processing steps can be applied to the fiber tow while it is transported on the transporting unit. Additionally, the fiber tow can be cut in a cutting apparatus and further post-processing steps can be performed on the cut fibers.

In FIG. 1 the post-processing is only schematically represented by the respective reference sign V.

Post-processing of the fibers can comprise, but are not restricted to, any combination of one or more of the following steps:

- washing of the fiber tow and/or the cut fibers,
- squeezing the fiber tow and/or the cut fibers to reduce the amount of liquid therein,
- neutralizing the fiber tow and/or the cut fibers with an acidic liquid,
- bleaching the fiber tow and/or the cut fibers,
- crosslinking the fiber tow and/or the cut fibers by applying a crosslinking agent on the fibers,
- applying a finishing agent ("soft finish") to the fibers of the fiber tow and/or the cut fibers,
- drying the cut fibers.

Immediately after the fibers in the fiber tow have been withdrawn from the coagulation bath, they already have been stretched to a certain extent, but may not have reached their final elongation (and final cellulose specific diameter).

In a different approach, several successive stretching steps during the post-processing can be implemented. For example a counter current flow washing can be implemented in the post processing, wherein the fibers in the fiber tow are being incrementally stretched during and/or in-between the several washing steps until they have reached their final extension.

According to another approach, the fiber tow can be led into a conditioning bath comprising from 10 percent per weight to 30 percent per weight a salt that facilitates a further coagulation of the spinning solution, the conditioning bath preferably being fluidly separated from any downstream washing facilities, and stretched to essentially the final cellulose specific diameter of the fibers and oriented to essentially their final state within the conditioning bath. The conditioning bath can comprise a coagulation liquid that is similar or identical to the coagulation bath liquid. The coagulation speed in the conditioning bath can be adjusted by the temperature of the liquid therein, which preferably can be controlled independently from the coagulation bath.

Following the second bath, the fiber tow can be washed in a downstream washing line, where no additional stretching is applied to the fiber.

As the case may be (and according to the technical requirements), other post-processing steps can be arranged in the processing line according to any technically useful configuration.

Figure 2:
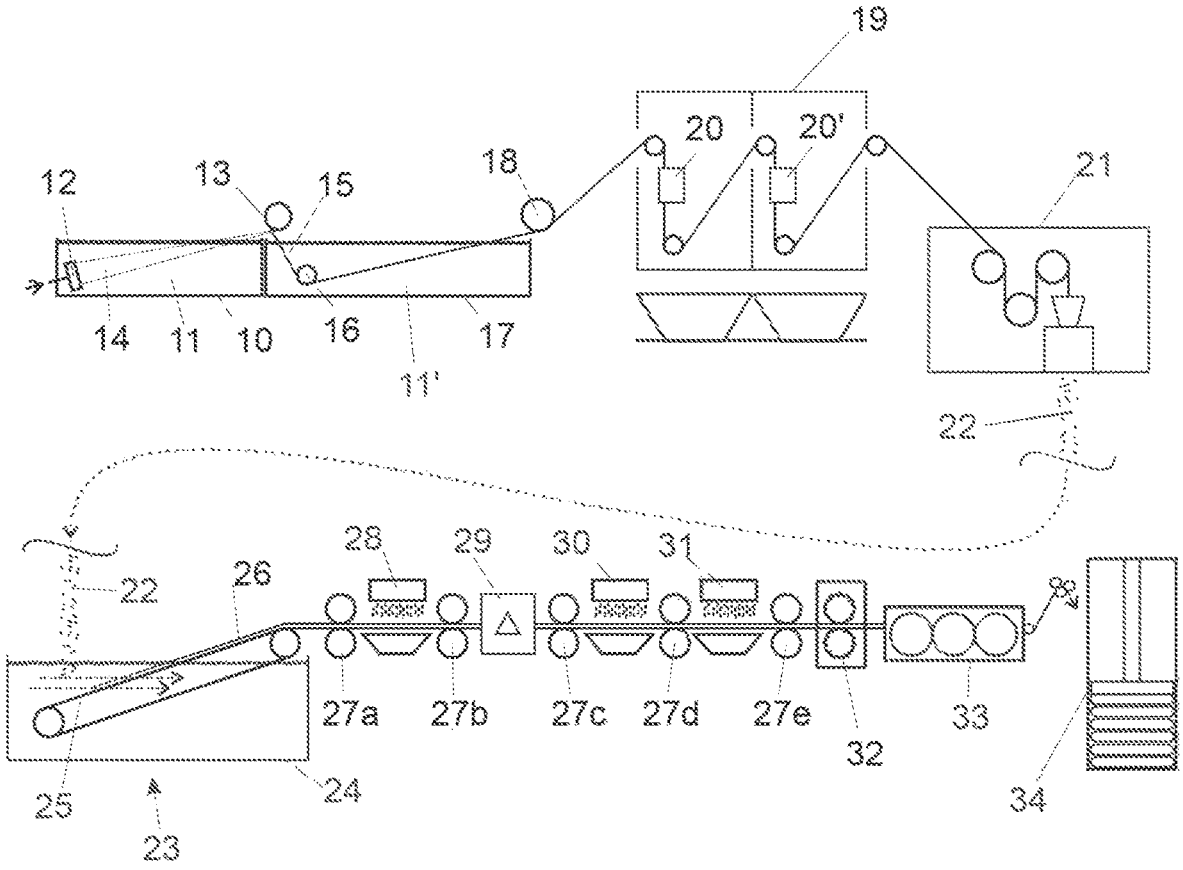

FIG. 2 is a schematic block-diagram showing an exemplary configuration of a post-processing facility for treating a fiber-tow which is produced according to the current disclosure, e.g. by the facility depicted in FIG. 1.

Fibers 14 are extruded by a spinneret 12 into a coagulation liquid 11 within a coagulation bath 10 and gathered together into a fiber tow 15 by the first godet 13 (similar to FIG. 1). From the first godet 13 the fiber tow is directed to a second godet 18. Between the first godet 13 an the second godet 18 the fiber tow 15 is diverted via a guide 16, e.g. a roller, bar or the like, and submerged into a conditioning bath 17 containing a coagulation liquid 11'. The coagulation liquid can be identical or similar to the coagulation liquid 11 in the coagulation bath 10. Preferably the coagulation liquid 11 in the coagulation bath 10 and the coagulation liquid 11' in the conditioning bath 17 are circulated in a common fluid cycle. Preferably the temperature of the coagulation liquid 11' in the conditioning bath 17 can be controlled independently from the temperature of the coagulation liquid 11 in the coagulation bath 10. Generally a higher temperature is preferred for the coagulation liquid 11' in the conditioning bath 17. For example, the temperature of the coagulation liquid 11 in the coagulation bath 10 can be adjusted to a value between about 10° C. and about 20° C. and the temperature of the coagulation liquid 11' in the conditioning bath 17 can be adjusted to a value between about 20° C. and about 40° C.

Between the first godet 13 and the second godet 18 and essentially within the conditioning bath 17 the fibers in the fiber tow are stretched to essentially their final cellulose specific diameter and oriented to essentially their final state.

In FIG. 2 only one conditioning bath is shown. Nonetheless it would be possible to install more than one conditioning bath, for example two successive conditioning baths or a series of consecutive conditioning baths. Preferably the conditioning baths share the same fluid circuit with the coagulation bath and have an essentially identical or at least similar content of salt and/or alkali. The temperatures of the conditioning baths can either be the same or controlled independently, as the case may be. Depending on the configuration, the fibers can, for example, be stretched in a cascading style, i.e., consecutive conditioning baths have an increasing stretching rate. The fibers could also be stretched to essentially their final state in an upstream conditioning bath (or several upstream conditioning baths) and then be further coagulated and "fixated" within one (or more) downstream conditioning bath(s) with constant speed and stretch. The person skilled in the art and having knowledge of the teachings disclosed herein is able to optimize the number of conditioning baths, their temperatures and extension rated by routine tests and experiments without deviating from the scope of the current disclosure. The fiber parameters, such as tensile strength, elongation, crystallinity etc., can so be optimized in a methodical manner.

From the second godet 18 the fiber tow 15 is directed to a washing line 19 which can comprise several washing steps which are exemplarily depicted in FIG. 2 as washing steps 20 and 20'. As the case may be, the washing line 19 can also comprise only one washing step 20 or any number of washing steps exceeding two. Further, any washing techniques for washing fiber tows, that are known per se in the art, can be used for in the washing line 19.

The transporting means the fiber tow, such as rollers and godets or the like, in the washing line are operated at a constant speed so that the tension is kept essentially constant and no further stretching of the fibers in the fiber tow occurs. This also keeps the orientation of the fibers essentially at the state they were when leaving the second godet 18 after the stretching within the conditioning bath.

After the washing line 19 the fiber tow 15 is directed to a cutter 21, which cuts the fiber tow into staple fibers 22. During the washing steps 20 the consistency of the fibers has sufficiently settled so that the fibers essentially keep their cellulose specific diameter, elongation and orientation even if they are cut in wet or never-dried state. Therefore, it is not necessary to dry the fiber tow 15 before cutting, which can reduce costs and allows for the implementation of more efficient post-processing steps.

In the lower part of FIG. 2 an exemplary post-processing facility for the cut staple fibers is shown. The cut staple fibers are transported (or fall) from the cutter 21 to a fleece-forming device 23 having a basin 24 filled with a liquid, e.g., water, and a conveyer belt 25. The conveyer belt 25 is permeable to liquid and a current is maintained in the basin that transports the fibers that are suspended in the liquid of the basin to the conveyer belt 25, where they are collected and form a non-woven fiber layer 26 on the top surface of the conveyer belt 25. The surface of the conveyor belt is tilted and transports the newly formed non-woven fiber layer 26 out of the liquid and to further transport equipment (which is, for reasons of conciseness, not shown in FIG. 2). The freshly cut staple fibers 22 should be regularly distributed across the width of the fleece-forming device 23 so that the non-woven fiber layer 26 has a uniform width and consistency.

After leaving the fleece-forming device 23, the non-woven fiber layer 26 is squeezed in a first pressing device 27*a* to remove some of the liquid in the non-woven fiber layer 26. Several further pressing devices 27*b* to 27*e* can be arranged downstream between several processing steps. Especially the first pressing device 27*a*, but also the other pressing devices, create a natural crimp on the fibers in the non-woven fiber layer which is preferable for many fiber appliances.

The post-processing that is performed on the non-woven fiber layer 26, as it is shown in FIG. 2, comprises a neutralizer 28, a bleaching facility 29, a crosslinking facility 30, a finishing facility 31, an opener 32, a dryer 33 and a baling press 34.

In the neutralizer 28 the fibers that may still contain residues of alkali are neutralized with an acidic liquid, which can be selected from a list comprising diluted acetic acid, lactic acid, sulphuric acid or the like. Depending on the specific processing conditions, a neutralizing step may not always be necessary.

The fibers in the non-woven fiber layer 26 are then bleached in bleaching facility 29. If appropriate, a further washing step (not shown in FIG. 2) can be implemented between the neutralizer 28 and the bleaching facility 29. The used water of this (and any other) washing step can be forwarded to upstream washing steps and/or the cutter 21 of the washing line 19 in the form of a countercurrent washing system.

In the crosslinking facility 30 a crosslinking agent can be applied to the fibers in order to reduce fibrillation of the fibers and improve the processing and handling of the fibers in the textile chain.

In the finishing facility 31 a finishing agent or soft finish can be applied to the fibers.

After dewatering the non-woven fiber layer 26 in the pressing device 27*e* the non-woven fiber layer 26 is fed into an opener 32, which loosens and opens the structure of the fiber layer 26 to improve the drying efficiency in the following dryer 33 and also to improve the further processing of the finished staple fibers.

EXAMPLES

Four fiber samples were produced according to the protocols described herein.

For the preparation of fiber samples prehydrolysis kraft pulp (PHK) with an intrinsic viscosity in Cuen of 405 mL/g was used as a raw material. The pulp was pretreated in 10 percent per weight sulfuric acid at 70° C. for a duration of 23 min to get an intrinsic viscosity of 255 mL/g. The pretreated pulp was washed and squeezed to reduce the moisture content.

A spinning solution was prepared according to the methods disclosed herein by dissolving the pulp in an aqueous solvent comprising NaOH and ZnO, the final spinning solution comprising 6 percent per weight celluloses, 2.3 percent per weight ZnO and 7.5 percent per weight NaOH. The spinning solution was blended and homogenized under cooling in a high-shear mixer and them filtered and deaerated. During mixing the temperature of the spinning solution was kept in a range between 0° C. and 5° C. The ballfall viscosity according to DIN 53015-2019 was adjusted to 65 sec.

For the production of the fiber samples in a laboratory scale pilot plant the spinning solution was extruded through a 91 holes spinneret, each hole having a diameter of 100 μm, into a coagulation bath comprising an aqueous solution of 15 percent per weight sodium carbonate ($Na_2CO_3$) and 0.5 percent per weight NaOH. The temperature of the coagulation bath was conditioned to 19° C. The extruded fiber tow was led to a first godet with a coagulation bath distance of about 20 cm, wherein the dwell time in the coagulation bath was greater than 1.5 s. From the first godet the fiber tow was threaded to a second godet, wherein the fiber tow was directed through a conditioning bath containing an aqueous solution of 15 percent per weight sodium carbonate ($Na_2CO_3$) and 0.5 percent per weight NaOH (same as the coagulation bath) at an elevated temperature of 42° C.

The fibers were drawn to their final elongation within the conditioning bath, i.e., between the first and the second godet. The second godet was set to a speed of 12 m/min and the pull-off speed of the first godet was set to reach a selected final extension which differed between the samples.

Depending on the sample, the fibers were either washed within the fiber tow before cutting or cut before washing.

Three comparative examples were produced according to the same protocol but dried within the fiber tow and cut dry.

The following properties of the resulting fibers were assessed (according to DIN EN ISO 1973:1995-12 and ISO 3341:2000-05):

Fiber titer [dtex]

Tensile strengths—FFk [cN/tex]

Elongation—FDk [%]

Table 1 shows the results of the sample fibers produced according to the methods disclosed herein. Results for the Comparative Examples are shown in Table 2.

TABLE 1

| Fiber samples | | | | |
|---|---|---|---|---|
| Sample Nr. | 1 | 2 | 3 | 4 |
| Titer [dtex] | 1.56 | 1.59 | 1.73 | 1.70 |
| FFk [cN/tex ] | 13.1 | 16.1 | 14.0 | 14.9 |
| FDk [%] | 7.0 | 8.0 | 9.0 | 9.5 |
| Final extension | 70 | 70 | 75 | 80 |
| Washing step | cut fibers | fiber tow | fiber tow | fiber tow |
| Cutting | immediately after $2^{nd}$ bath | after washing | after washing | after washing |
| Drying | cut fibers | cut fibers | cut fibers | cut fibers |

TABLE 2

| Comparative examples | | | |
|---|---|---|---|
| Comparative Example Nr. | 1 | 2 | 3 |
| Titer [dtex] | 1.56 | 1.76 | 1.61 |
| FFk [cN/tex ] | 16.8 | 13.1 | 16.3 |
| FDk [%] | 4.1 | 3.8 | 4.7 |
| Final extension | 70 | 70 | 75 |
| Washing step | fiber tow | fiber tow | fiber tow |
| Cutting | after drying | after drying | after drying |
| Drying | fiber tow | fiber tow | fiber tow |

The results show that fibers according to the Samples 1 to 4, that have been cut in wet state, surprisingly show a significantly higher elongation than the fibers of the comparative examples 1 to 3, that have been dried before cutting, i.e., while still in the fiber tow.

The preferred embodiments of the disclosure have been described above to explain the principles of the present disclosure and its practical application to thereby enable others skilled in the art to utilize the present disclosure. However, as various modifications could be made in the constructions and methods herein described and illustrated without departing from the scope of the present disclosure, it is intended that all matter contained in the foregoing description or shown in the accompanying drawings, including all materials expressly incorporated by reference herein, shall be interpreted as illustrative rather than limiting. Thus, the breadth and scope of the present disclosure should not be limited by the above-described exemplary embodiment but should be defined only in accordance with the following claims appended hereto and their equivalents.

REFERENCE SIGNS dissolving pulp 1
source for a pretreatment chemical 2
pretreatment vessel 3
chemical repository 4
solvent cooling device 5
pulp cooling device 6
mixing vessel 7
de-aerating filter 8
cooling jacket 9
coagulation bath 10
coagulation liquid 11
spinneret 12
first godet 13
fibers 14
fiber tow 15
guide 16
conditioning bath 17
second godet 18
washing line 19
washing step 20
cutter 21
staple fibers 22
fleece-forming device 23
basin 24
conveyer belt 25
non-woven fiber layer 26
pressing device 27
neutralizer 28
bleaching facility 29
crosslinking facility 30
finishing facility 31
opener 32
dryer 33
baling press 34

The invention claimed is:

1. A method for producing regenerated cellulosic fibers comprising extruding a spinning solution into a coagulation bath which contains a salt and an alkali to produce a fiber tow, the spinning solution comprising cellulose dissolved in an aqueous solvent comprising NaOH and ZnO, the coagulation bath having a pH-value of at least seven, the method comprising the steps of:

stretching the fibers in the fiber tow to a final cellulose specific diameter before being cut to staple fibers in an undried state; and orienting the fibers in the fiber tow to a final state before being cut to staple fibers in an undried state.

2. The method according to claim 1, further comprising the steps of:

routing the fiber tow into at least one conditioning bath, the conditioning bath comprising between about 10 percent to about 30 percent per weight a salt to facilitate a further coagulation of the spinning solution, the conditioning bath being fluidly separated from a downstream washing line; and stretching the fibers in the fiber tow to the final cellulose specific diameter and orienting the fibers in the fiber tow to the final state in the at least one conditioning bath.

3. The method according to claim 2, wherein the coagulation bath and the conditioning bath are fluidly connected, wherein a temperature of the coagulation bath and a temperature of the conditioning bath are independently controlled.

4. The method according to claim 1, further comprising the steps of:

routing the fiber tow through a washing line, the washing line comprising at least one washing step, wherein the washing line is arranged downstream of at least one conditioning bath; and keeping a tension of the fiber tow and a cellulose specific diameter of the fibers constant in the washing line.

5. The method according to claim 1, further comprising the steps of:

suspending the cut fibers and collecting the cut fibers in a non-woven fiber layer, pressing the non-woven fiber layer to impose a natural crimp on the fibers.

6. The method according to claim 1, further comprising at least one of the following steps:

collecting the cut fibers into a non-woven fiber layer and washing the non-woven fiber layer;

neutralizing the cut or uncut fibers with an acidic liquid, wherein the acidic liquid is one of diluted acetic acid, lactic acid, and sulphuric acid;

bleaching the cut or uncut fibers;

applying a crosslinking agent to the cut or uncut fibers;

applying a finishing agent to the cut or uncut fibers;

drying the fibers;

pressing the fiber tow and/or the non-woven fiber layer before and/or after any other processing step.

7. The method according to claim 1, further comprising at least one of opening a non-woven fiber layer to loosen up and/or at least partially separate the fibers.

* * * * *